United States Patent [19]

Glossop

[11] Patent Number: 5,056,563

[45] Date of Patent: Oct. 15, 1991

[54] HIGH PRESSURE GAS CHARGING APPARATUS

[76] Inventor: Ronald Glossop, 208 Urmston La., Stretford, Manchester, M32 9DH, England

[21] Appl. No.: 529,499

[22] Filed: May 29, 1990

[30] Foreign Application Priority Data

Jun. 2, 1989 [GB] United Kingdom ..... 8912693

[51] Int. Cl.[5] ..... F17C 5/00

[52] U.S. Cl. ..... 137/883; 137/615; 285/163

[58] Field of Search ..... 285/179, 181, 272, 163; 137/83, 886, 580, 615; 251/148

[56] References Cited

U.S. PATENT DOCUMENTS 2,288,297 4/1940 Naiman ..... 137/78
3,809,121 5/1974 Harris ..... 137/613
4,354,698 10/1982 Linder et al. ..... 285/98

FOREIGN PATENT DOCUMENTS 726561 10/1942 Fed. Rep. of Germany ..... 137/886
1587090 2/1991 United Kingdom ..... 137/883

*Primary Examiner*—Martin P. Schwadron
*Assistant Examiner*—Kevin L. Lee
*Attorney, Agent, or Firm*—Ross, Ross & Flavin

[57] ABSTRACT

A common manifold, which is connectable to a source of pressurized gas, is connected via two symmetrical sets of rigid components to respective coupling elements, which are connectable directly to vessels to be charged with gas. Since there is no flexible hose section the risk of bursting at high pressure is obviated. To facilitate connection of vessels at any convenient position each set preferably includes at least one component which is rotatable and at least one elbow joint.

3 Claims, 3 Drawing Sheets

HIGH PRESSURE GAS CHARGING APPARATUS

TECHNICAL FIELD

This invention relates to apparatus enabling cylinders or other vessels to be charged with high pressure gas.

BACKGROUND ART

Conventionally, cylinders have been filled with compressed air by way of appropriate valves and couplings and a flexible hose connection from a pressurised source, for example as disclosed in GB No. 2200198 to the BOC Group plc. That was satisfactory, even if the connection apparatus was sometimes untidy and cumbersome, for air pressures up to and in the region of 2000 psi (141 Kg/sq cm approx), which was the standard pressure used in air cylinders for fire fighting purposes, and other portable air supply purposes. Recently, however, a requirement has arisen for air cylinders to be filled to greater pressure, in the region of 4000 psi (282 Kg/sq cm approx) so that the cylinders are less rapidly exhausted. At these higher pressures there is a risk that the flexible hose sections of conventional charging apparatus may burst open, particularly if they have any faults. This would clearly be dangerous for operatives, as well as putting the apparatus out of commission until repaired.

OBJECT OF THE INVENTION

It is an object of the present invention to provide improved charging apparatus which is compact, universal in its application (i.e. applicable to any gas and any form of vessel), and which is capable of reliable operation at high gas pressures so as to avoid the abovementioned problem.

SUMMARY OF THE INVENTION

Pursuant hereto, the invention provides charging apparatus composed of a plurality of rigid components, including an element, such as a manifold, adapted for connection to a gas source, and a coupling element adapted for direct connection to a vessel to be charged, connected together in non-flexible manner, at least one of said components being rotatable relative to an adjoining component.

Thus, there is no flexible hose section giving rise to a risk of failure.

Preferably the components are connected in series and include an elbow element. This tends to facilitate easy access to the apparatus for attachment of a vessel to be charged, generally a cylinder.

Moreover, for the same reason, the elbow element may conveniently constitute the rotatable element. An alternative or additional rotatable element may, however, be provided, an additional such element being especially advantageous as it provides greater versatility in the positioning of the coupling for connection of the vessel to be charged.

One particularly advantageous version of the apparatus includes two coupling elements so that two vessels can be simultaneously charged. Conveniently such apparatus is symmetrically constructed with a single common element connected to the gas source, respective elbow elements, one at each side thereof, and the respective coupling elements connected to the respective elbow element.

The components connecting the or each coupling element to the element connectable to the gas source preferably include, in each case, an adjustable charging valve provided with a manually actuable control knob.

In preferred practical embodiments the or each said charging valve consists of a specially designed component comprising a valve body formed with intersecting first and second passageways therethrough, the first passageways having an inlet/outlet port at one end and the aforesaid control knob disposed at its other end, and having a valve seat located therebetween, the control knob being threadedly adjustable to move a valve element into contact with the valve seat or out of contact at varying spacing therefrom, and the second passageway having an inlet/outlet branch closable by said valve element and a branch fitted with bleed means.

BRIEF DESCRIPTION OF DRAWINGS

Practical examples of apparatus in accordance with the invention will now be described with reference to the accompanying drawings, in which.

DETAILED DESCRIPTION OF ILLUSTRATED EMBODIMENTS

Figure 1:
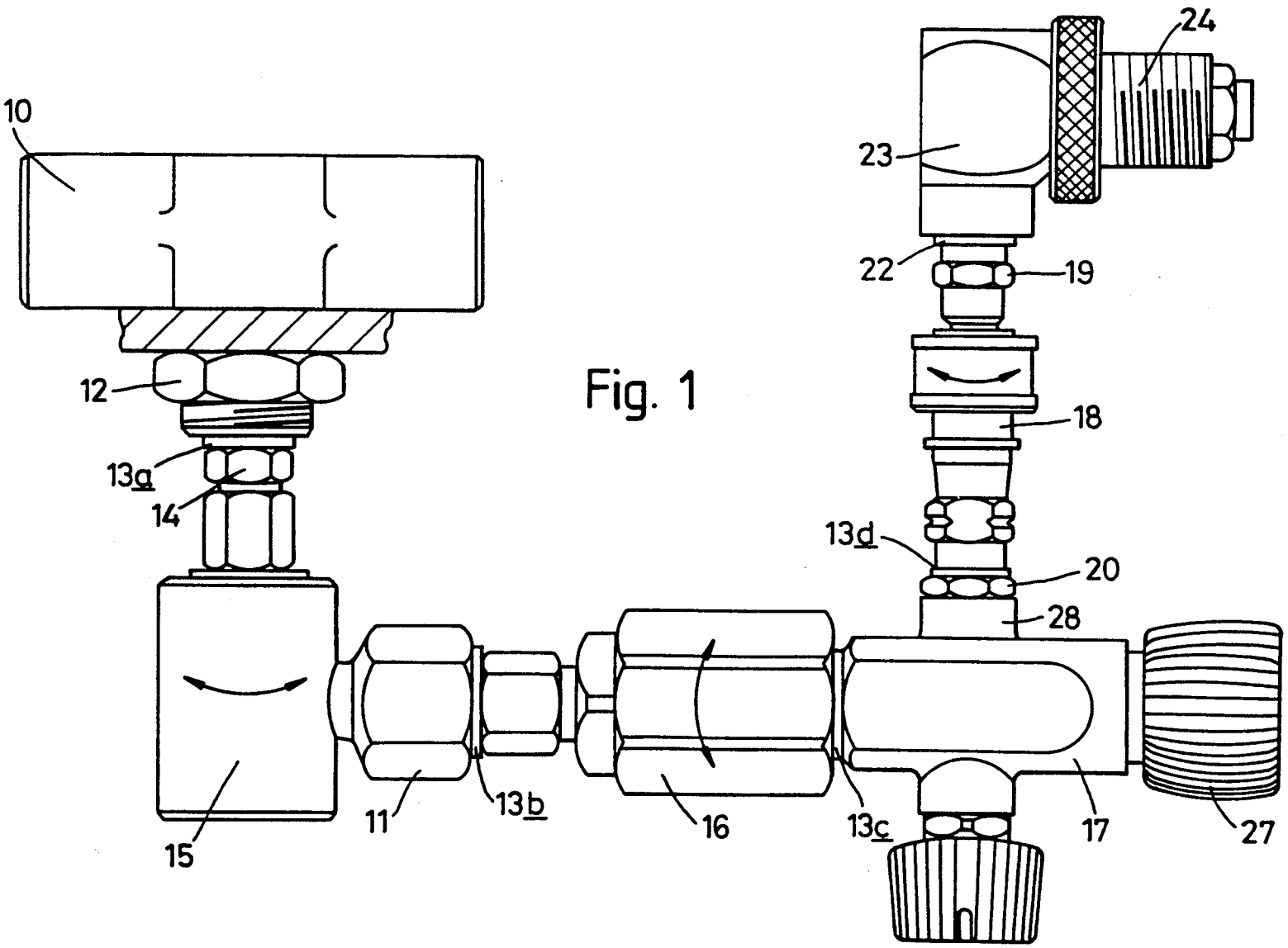
FIG. 1 is a side view of a first embodiment of the apparatus.

The embodiment shown in FIG. 1 is for charging a single cylinder. It comprises a manifold 10 connected by way of a locknut 12, a dowty seal 13*a* and a male adaptor 14 to a rotatable elbow element 15. The elbow element includes a cylindrical outer barrel which is rotatable relative to an inner body and which carries a lateral limb 11. The limb 11 is connected via a further dowty seal 13*b* to a rotary component 16, which comprises an outer barrel having a polygonally contoured surface. This outer barrel is rotatable relative to an inner body and is connected at its opposing end, by way of a further dowty seal 13*c* to a charging valve 17, the detailed construction of which is shown in and will shortly be explained by reference to FIG. 3. At present it is sufficient to note that this valve 17 includes a ribbed control knob 27 at its end opposite the rotary component 16, and has a lateral branch 28, perpendicular to its longitudinal axis, which is connected by way of a further male adaptor 20, and a further dowty seal 13*d* to a quick release connector, such as a commercially available Hanson connector 18 (which is rotatable) and corresponding plug 19. The plug is connected via a dowty washer 22 to a high pressure elbow component 23, the other limb of which carries a high pressure coupling 24 of appropriate size and configuration for direct sealing connection to a commerically available gas storage cylinder.

All the components are preferably made of steel, with rubber O-rings and dowty seals. The connections are for the most part by screw threaded engagement.

In use, the manifold 10 is mounted at any suitable location, e.g. on a wall or special support, and connected to a pipe from a pressurized gas source. Relative to the manifold 10, once secured in this way, the position of the final coupling 24 can be adjusted in three ways, by rotation of the elbow 15 to swing the following rigidly constructed components 16 and 17 in one plane, rotation of the component 16 to swing the following components 17 to 24 in a substantially perpendicular plane, and further by rotation of the Hanson connector 18 to swivel the coupling 24. Thus it is always possible to adjust the angular orientation and the position of the final coupling 24 for ready attachment thereto of an air cylinder inlet valve means.

Once the said connection of the air cylinder is accomplished supply of the relevant pressurized gas, and for the sake of example here it will be considered as compressed air as that is most common, is switched on and off, and adjusted in flow rate by turning the knob 27 of the valve 17.

Figure 2:
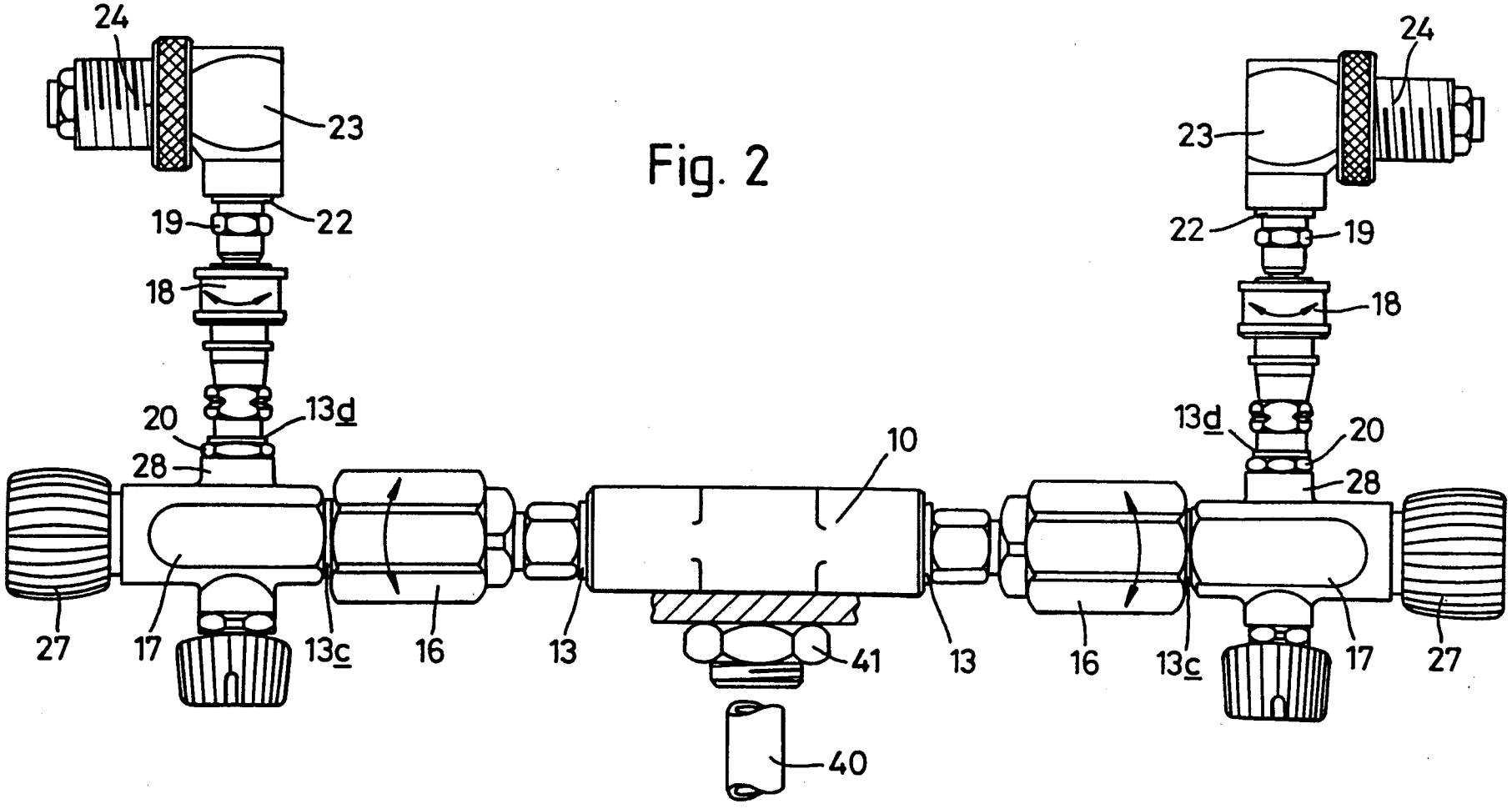
FIG. 2 is a side view of a second embodiment of the apparatus.

The embodiment illustrated in FIG. 2 has two charging stations so can, if desired be used for charging two cylinders simultaneously, by respective couplings 24. Basically, most of the components as in the single charge embodiment of FIG. 1 are employed, connected in the same sequence, but two sets of such components are provided extending from opposing sides of the manifold 10. The same reference numerals will be used for corresponding parts to facilitate understanding.

This double charging embodiment then comprises, connected to one end of the manifold 10, by way of a dowty seal 13, a rotary component 16, and, in turn, by way of a further dowty seal 13*c*, a charging valve 17 with a control knob 27 and a lateral branch 28. The said perpendicular branch 28 is connected by way of a male adaptor 20 and further dowty seal 13*d*, to a quick release (Hanson) connector and plug 18, 19, and the plug 19 is connected by way of a dowty washer 22 to a high pressure elbow component 23 and associated cylinder coupling 24.

Thus compared to the single charging version of FIG. 1, this "arm" simply lacks the rotary elbow element 15 and associated connection pieces 12, 14, as the rotary component 16 is attached directly to the manifold 10, and the changing valve 17 serves as a nonrotatable elbow element.

A further identical "arm" extends symmetrically from the other end of the manifold 10. Rotation of each coupling 24 in two planes is possible by way of the rotary component 16 and the Hanson connector 18.

In use the manifold 10 is mounted in any suitable location and connected centrally, by way of a locknut 41 to a pipe 40 from a source of pressurised gas, usually compressed air.

Supply of compressed air is then switched on and controlled by manual actuation of the knob 27 of the charging valve 17.

Figures 3, 3A:
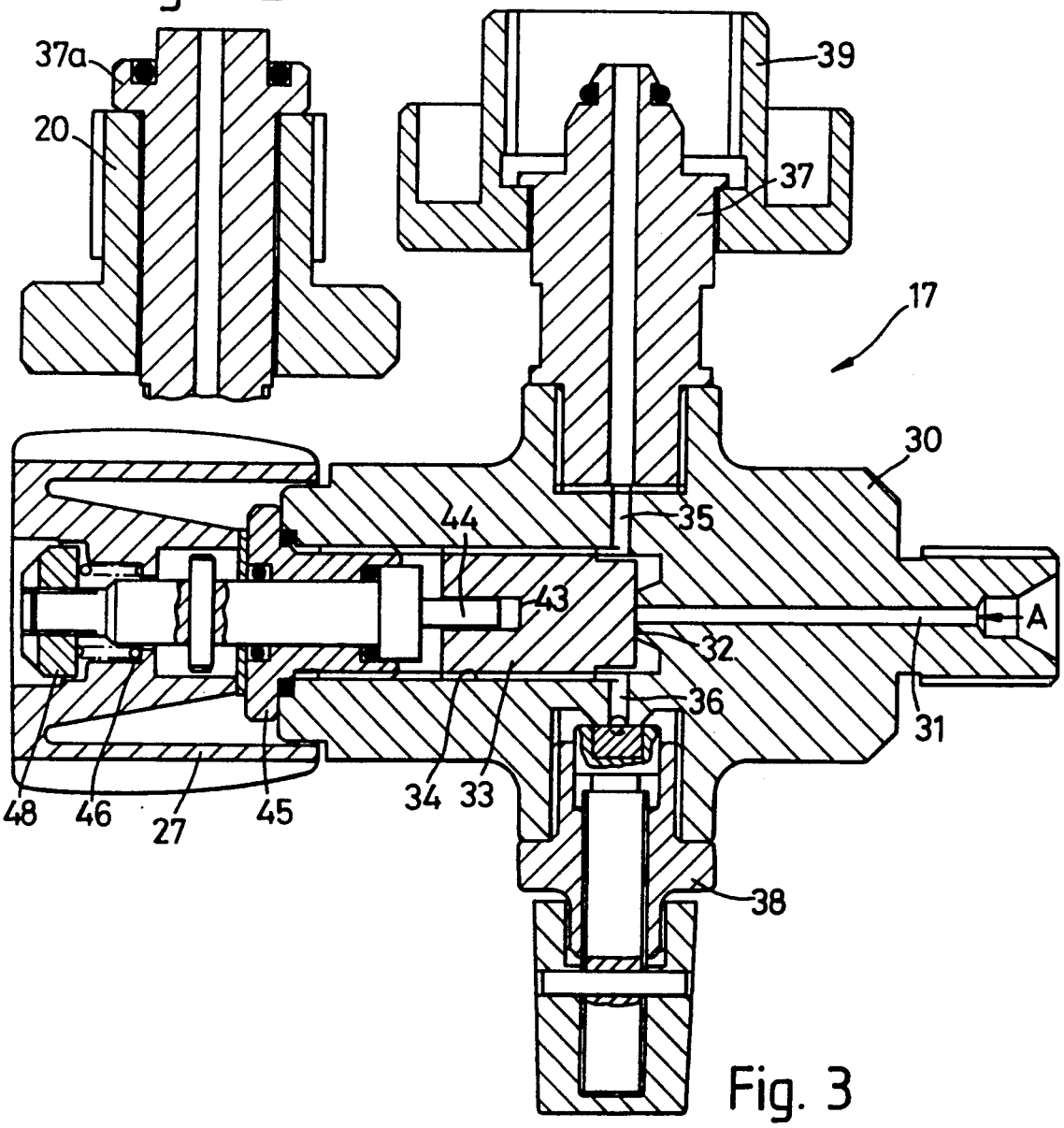
FIG. 3 is an enlarged cross-section of a charging valve used in both embodiments.
FIG. 3*a* is an enlarged cross-section of a modified main feed adaptor.

The charging valve 17, which is of the same construction in both the single and double charge embodiments, is especially designed for this purpose and is shown in detail in FIG. 3.

Basically this comprises a valve body 30 having four limbs at right angles and intersecting passageways, extending therethrough. Compressed air enters at 'A' from the connection with the rotary component 16, and the control knob 27 is located at the opposite end of the body 30. The passageway 31 from 'A' terminates in a seat 32 for a valve member 33 which is disposed in an enlarged passageway 34 extending to the knob 27. Adjacent the valve seat 32 opposing perpendicular passages 35, 36 lead from the enlarged passage 34 to an adaptor 37 and to a bleed screw assembly, labelled generally as 38, respectively. The main feed adaptor 37 in FIG. 3 has a female connector 39 attached. FIG. 3*a* shows a modified main feed adaptor 37*a* with a male connector attached, equivalent to male adaptor 20 in FIGS. 1 and 2. Obviously the respective adaptor arrangements are interchangeable depending on the component to which they are to be connected.

The valve member 33 is formed with a recess 43 into which a shaft 44 engages, the latter being movable along the passage 34 under the influence of a valve nut 45, against which the knob 27 presses. The knob 27 is threaded connected to the valve body at 47. When it is tightened it acts via the nut 45 and shaft 44 to push the valve member 33 against the seat 32, thus closing off the flow of air from A to the adaptor 37 via passages 34, 35. Conversely when the knob 27 is loosened, the shaft 44 and the valve member 33 are forced back by the air pressure and the flow passage is opened.

The shaft 44 is also spring biassed by a helical spring 46 which is retained in a countersunk bore in the knob by a further nut 48, whereby the sensitivity of valve control can be adjusted.

I claim:

1. Apparatus for charging portable pressurized gas cylinders comprising a single common element adapted for connection to a gas source, two coupling elements adapted for direct connection to respective cylinders which are to be charged, and respective series of rigid components whereby each of said coupling elements is respectively connected, in non-flexible manner, to said common element, each of said series of rigid elements including an elbow element, a quick release coupling, at least one rotatable connection and an adjustable charging valve provided with a manually actuable control knob.

2. Gas charging apparatus as set forth in claim 1, wherein said two coupling elements are symmetrically connected to said common element.

3. Gas charging apparatus as set forth in claim 1, wherein each said charging valve comprises a valve body formed with intersecting first and second passageways therethrough, said first passageway having an inlet/outlet port at one end and said control knob disposed at its other end, and having a valve seat located therebetween, said control knob being threadedly adjustable to move a valve element into contact with said valve seat or out of contact at varying spacing therefrom, and said second passageway having an inlet/outlet branch closable by said valve element and a branch fitted with bleed means.

* * * * *